US005167586A

United States Patent [19]

Morris

[11] Patent Number: 5,167,586

[45] Date of Patent: Dec. 1, 1992

[54] APPARATUS AND METHOD FOR DISPLAYING MINIATURE CAROUSEL FIGURINES

[76] Inventor: Terri-lee Morris, 6615 Tackawanna St., Philadelphia, Pa. 19135

[21] Appl. No.: 561,709

[22] Filed: Aug. 2, 1990

[51] Int. Cl.[5] ..... A63H 13/20

[52] U.S. Cl. ..... 472/6

[58] Field of Search ..... 272/31 R, 31 A; 472/6, 472/12

[56] References Cited

U.S. PATENT DOCUMENTS

| | | | |
|---|---|---|---|
| 239,601 | 4/1881 | Carl | 272/31 R |
| 631,306 | 8/1899 | Hollingsworth | 272/31 R X |
| 1,661,864 | 3/1928 | Zabel | 272/31 R |
| 1,701,503 | 2/1929 | Marx | 272/31 R X |
| 4,043,406 | 8/1977 | Wolf | 272/31 R X |

*Primary Examiner*—Richard E. Chilcot, Jr.
*Attorney, Agent, or Firm*—Reed, Smith, Shaw & McClay

[57] ABSTRACT

An apparatus and method for displaying miniature carousel figurines includes a plurality of bases, each having a miniature carousel figurine affixed to it. Each base is shaped such that a plurality of bases may be arranged to form a full or partial annular shape. The configuration of bases may be optionally affixed to the upper surface of a rigid mounting plate. Support feet may be mounted to the lower surface of the mounting plate to give the appearance that the entire apparatus is in motion and floating in air. The invention provides collectors of miniature carousel figurines with maximum versatility in the number of figurines and the manner in which they may be displayed.

23 Claims, 5 Drawing Sheets

APPARATUS AND METHOD FOR DISPLAYING MINIATURE CAROUSEL FIGURINES

BACKGROUND OF THE INVENTION

Carousels, also known as merry-go-rounds, have long been popular amusement rides. In the late nineteenth and early twentieth centuries, artisans including Gustav Denzel, Daniel Muller, Salvatore Cernigliaro, and E. Joy Morris designed and crafted carousels, some of which are in service today.

In recent years, there has been a renewed appreciation for carousels as an art form. Interest in the preservation, restoration, reproduction, and collection of various memorabilia related to carousels has also increased. Carousel enthusiasts now hold frequent auctions, trade shows, and conventions to display and trade various carousel artifacts. Trade publications such as "The Carousel News and Trader" and "Carousel Shopper" and special interest organizations such as the American Carousel Society and the National Carousel Association are also means by which enthusiasts promote the collection, preservation, restoration, and reproduction of such memorabilia.

Particular interest has centered around the design, creation, and collection of miniature carousel figurines. Such figurines include horses, giraffes, elephants, lions, and other animals as well as chariots, sleighs, and other figurines typically found on full size carousels. The collection of these figurines has created the need for a system by which the figures may be attractively, yet functionally and securely, supported and displayed. It is an object of this invention to provide such a system.

FIELD OF THE INVENTION

Typically, miniature carousel figurines are individually displayed on an base. The figurine may be mounted either directly to the base or on a pole which, in turn, is affixed to the base. See *Carousel Shopper*, Winter 1989 Catalog (examples of direct, and pole and base mountings shown). Figurines also have been displayed in groups on display stands which resemble carousels. See *The Wooden Soldier*, Holiday 1990 Catalog (individually mounted figurines placed on a circular stand). Another style of display stand provides recessed openings into which oval-shaped bases are inserted. This system is limited, however, in the number of figurines it may accommodate and in the configurations in which the figurines may be displayed.

There remains, therefore, the need for a system to display miniature carousel figurines wherein the system affords flexibility in both the number of figurines which may be displayed, and in the arrangement of those figurines. It is the solution of this problem to which this invention is directed.

SUMMARY OF THE INVENTION

It is the desire of many collectors to display their carousel figurines on a stand which gives the appearance of an actual carousel. However, the size and configuration of such a stand will vary with the number of figurines owned by, and the individual tastes of, each collector. For example, the owner of six figurines would not require the same size display stand as the owner of forty-eight figurines. Therefore, the need has arisen for a display stand which accommodates the individual size and taste requirements of each collector.

It is therefore a general object of this invention to provide a display stand which maximizes a collector's options in the display of his miniature carousel figurines.

It is another object of this invention to provide collectors with an aesthetically pleasing stand for the display of miniature carousel figurines.

It is another object of this invention to provide a carousel figurine display system which may be easily expanded to accommodate an increased number of figurines.

It is another object of this invention to provide an apparatus which displays miniature carousel figurines in a manner such that the figurines and apparatus appear to be in motion, particularly circular motion, weather the figurines are displayed individually or in groups.

It is yet another object of this invention to provide a display stand which gives the appearance that the miniature carousel figurines and display stand are floating in air.

The above-described needs have been met by the display stand and method of displaying miniature carousel figures of the present invention. The stand described herein accommodates the collector's needs for flexibility in both the number and configuration in which the figurines are to be displayed while maintaining a display which gives the appearance of an actual carousel. These needs are satisfied by shaping each figurine's base in such a manner such that the bases can be arranged adjacent to each other, either radially or circumferentially, about the center point of the stand.

In one preferred form, the bases have four sides. A pair of opposing sides are defined by two radii of a circle. The remaining opposing sides are defined by the arcs of concentric circles which share the same center point as the circle from which the radii emanate. When figurines on two such bases are displayed together, a second base adjoining the first base in the radial direction would share a common arc. This arc would define the first base's outer arc and the second base's inner arc. The second base's outer arc would be an arc concentric to its own inner arc and the first base's outer and inner arc. Successive bases could be added in the radial direction indefinitely. Alternatively, figurines on two such bases may be circumferentially adjacent and share a common radius.

In another embodiment, a four sided base has a pair of opposing sides also defined by two radii of a circle, however the remaining opposing sides are defined by the chords of the arcs of concentric circles described above.

Many other shapes for the bases which may be assembled to simulate an entire carousel or a portion thereof will also be readily apparent from studying this specification and the drawings and claims appended hereto.

In any embodiment of the invention, bases could be arranged circumferentially to form races around the center point of the display stand, the number of which would be limited only by the minimum distance between the two radii required to properly mount the figurines. Bases may also be arranged radially from the center point to form pie or wedge shaped sections, the number of which would be limited by the area in which the display is to be placed. Therefore, any number of figurines could be displayed in various configurations limited only by the space available for the display and the size of the figurine mounted to the base.

In another preferred form, the bases may be arranged in a configuration and affixed to the upper surface of a mounting plate. Additionally, support feet may be mounted to the lower surface of the mounting plate to give the display stand the appearance that it is floating above the surface upon which it rests and to keep the stand from slipping on that surface. The support feet may be made from any material suitable to support the weight of the base but are perfectly made from plaster or rubber materials.

These and other objects and features of the invention will be more fully understood from the following detailed description of the invention, on reference to the illustrations appended hereto.

BRIEF DESCRIPTION OF THE DRAWINGS

FIGS. 4 and 5 show top plan views of examples of various annular configurations of the preferred bases labelled details "A" through "G".

Figures 6, 7:
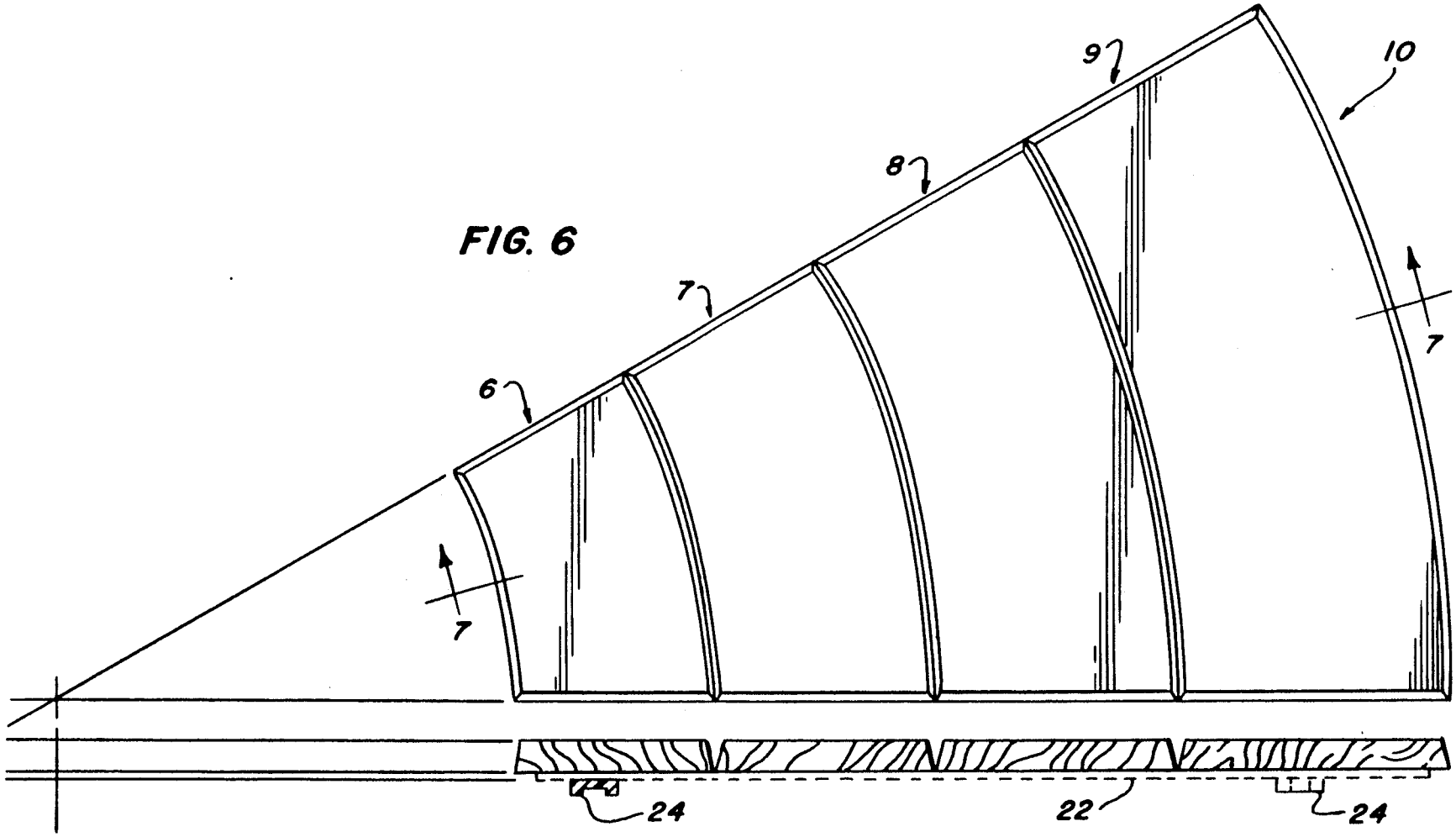
FIG. 6 shows a top plan view of a four race, one sector arrangement of bases of the preferred embodiment.

FIG, 7 is a cross sectional view, taken through 7—7 of FIG. 6 showing the combination of the bases, mounting plate and support feet.

Figure 8:
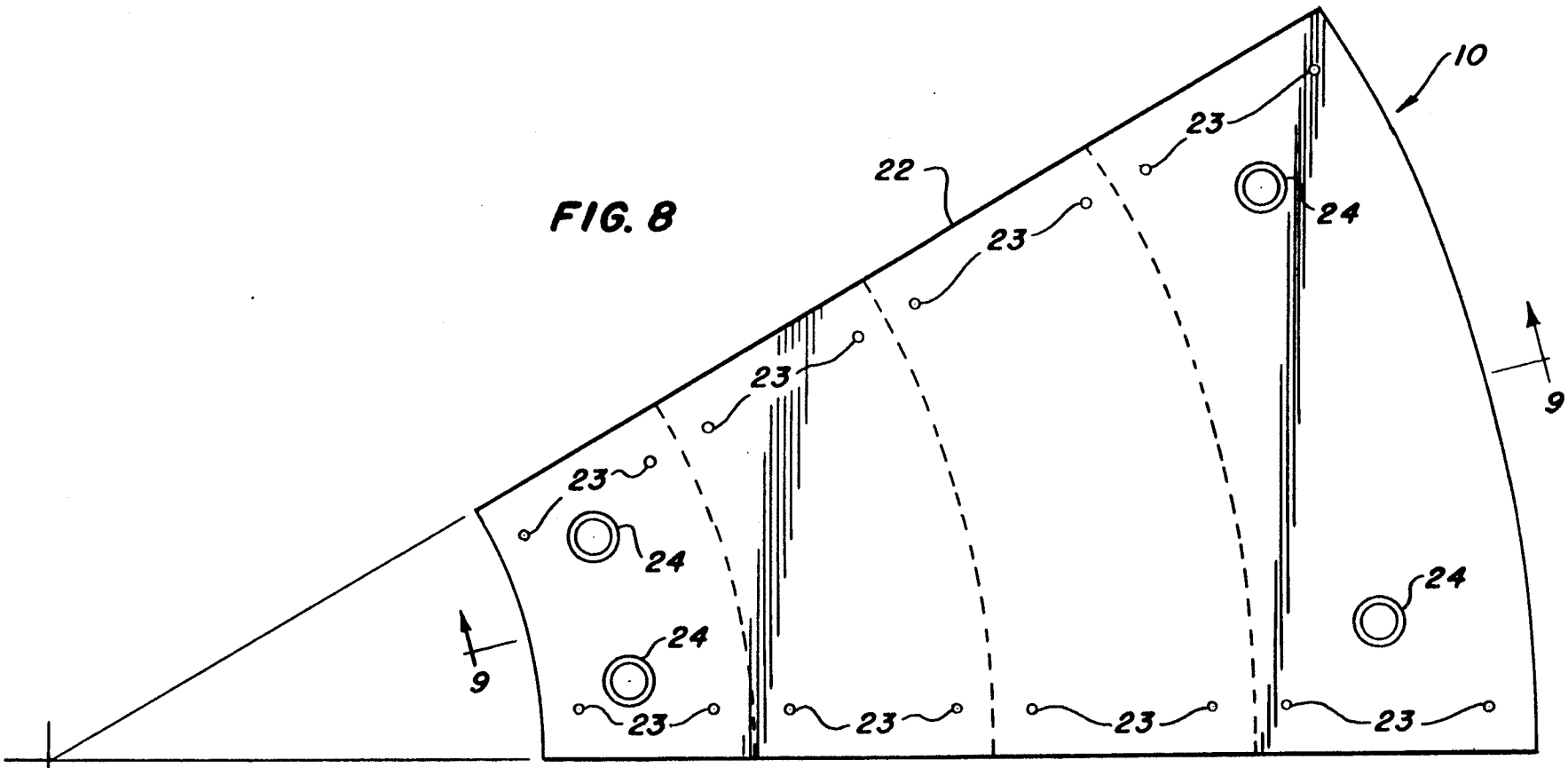

FIG. 8 is a bottom view of the mounting plate shown in FIG. 7 detailing the preferred arrangement of the holes for the screws affixing the bases to the base plate.

Figure 9:
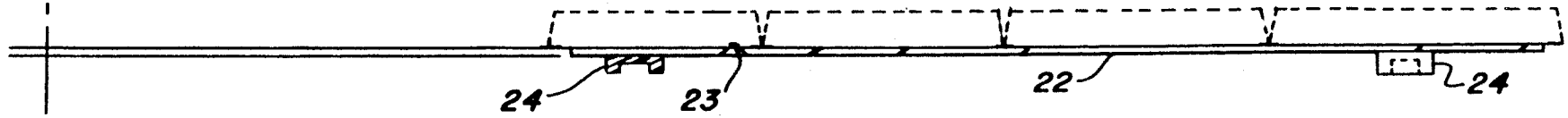

FIG. 9 is a cross sectional view, taken through 9—9 of FIG. 8 with the bases in phantom and showing a typical preferred counter sunk mounting screw.

Figures 1, 2, 3, 4A, 4B, 5C, 5D, 5E, 5F, 5G:
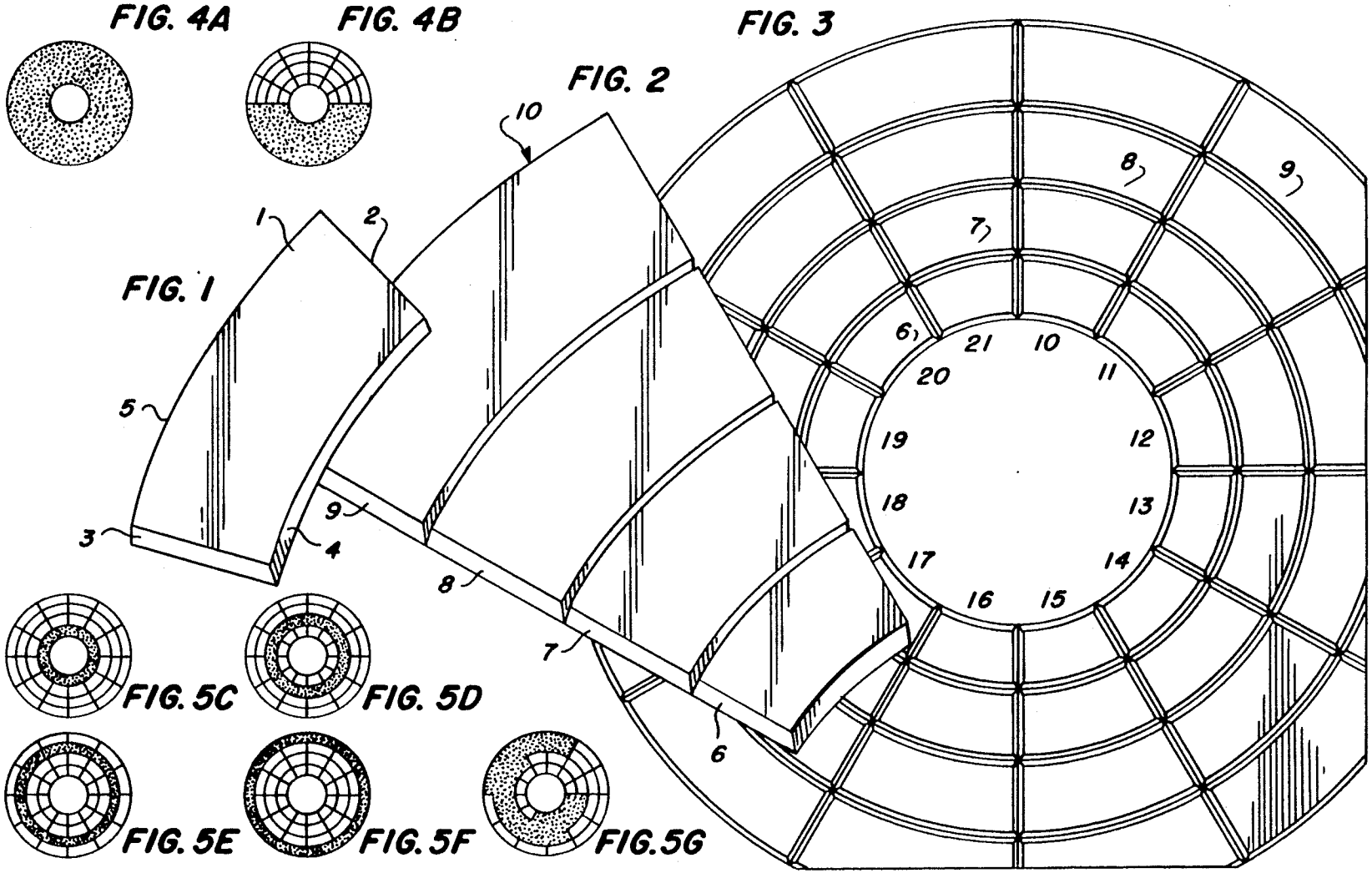
FIG. 1 is a perspective view of an base upon which a figurine may be mounted.
FIG. 2 is a perspective view of four bases arranged radially to form a one sector four race section 10.
FIG. 3 is a partially schematic top plan view of a twelve sector, four pace, full annular configuration of the stand.
Figure 10:
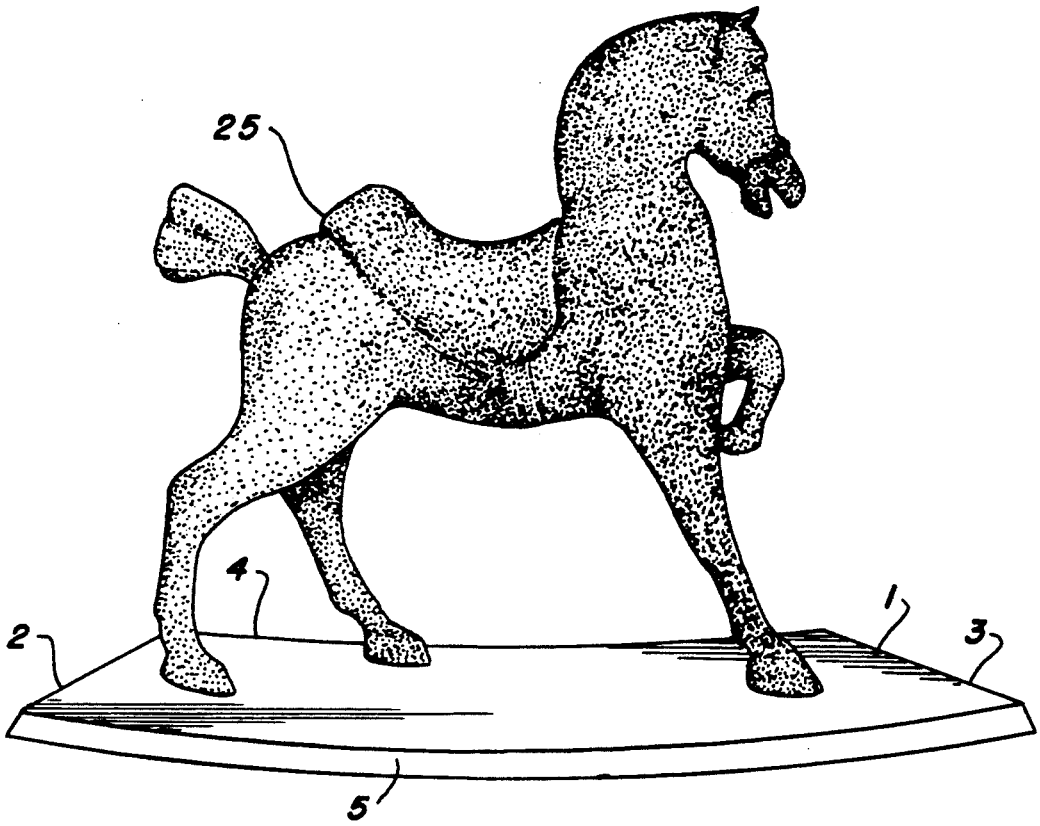

FIG. 10 is a perspective view, taken from side 5 of FIG. 1, of a miniature carousel figurine affixed to the preferred base.

Figure 11:
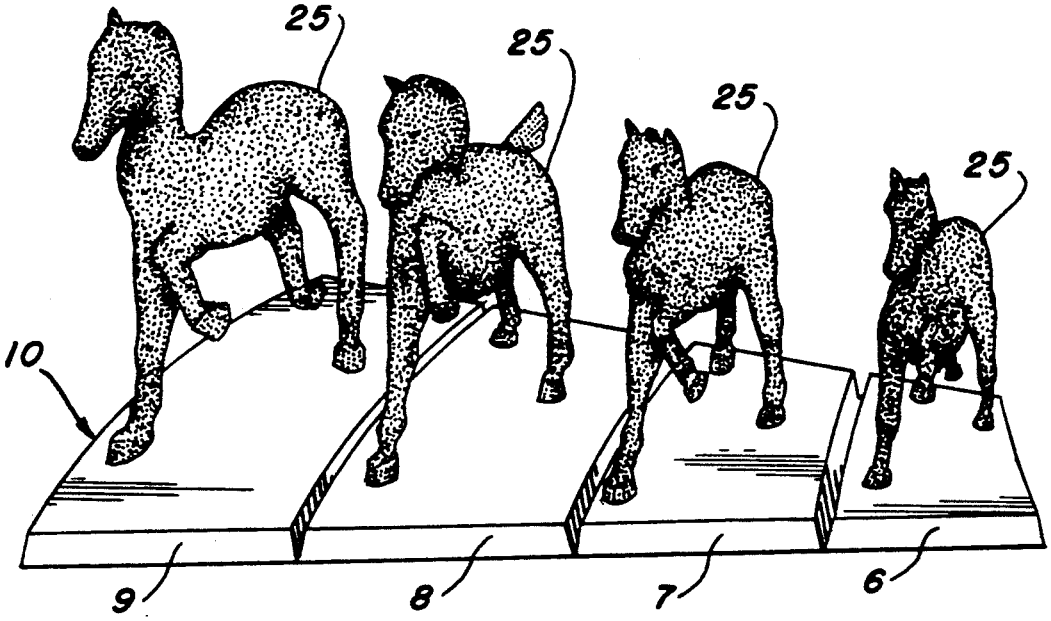

FIG. 11 is a perspective view, taken from the side adjacent to sector 21 of FIG. 3, of sector 10 of FIG. 2 with miniature carousel figurines affixed thereon.

DETAILED DESCRIPTION OF THE PREFERRED EMBODIMENTS

Referring now more particularly to FIG. 1, there is shown the preferred embodiment of a base 1 upon which a figurine may be mounted. The base is a generally planar member adapted to be disposed in a substantially horizontal manner for display purposes. While each base 1 may be constructed from almost any material suitable for affixing a figurine, wood, especially hardwood, is preferred. Of all woods, walnut is most preferable. Alternatively, bird's-eye maple is also a preferred wood. Both walnut and bird's-eye maple are preferred for their strength and attractiveness. Bird's-eye maple's aesthetic and strength characteristics result from the wood's random rather than lineal graining.

Each base 1 may have three or more sides, however, four sides is preferred. In the four sided embodiment, sides 2 and 3 are defined by two radii of a circle. Sides 4 and 5 may be defined by any curves, but preferably the curves are defined by the arcs of concentric circles whose center point is the same as that of the circle from which the radii emanate.

Optionally, one or more of the sides of the base may be beveled. For instance, sides 2, 3, 4 and 5 may be beveled to an angle of approximately ten degrees from vertical. Alternatively, base 1 may have one or more sides partially beveled such that each side would comprise an upper beveled portion and a lower vertical side portion. In this embodiment the bevel may be for instance about 15 degrees from vertical. The beveled sides are advantageous because the bevel allows for ease in mounting adjacent bases and the enhancement of the overall aesthetic appearance of the stand.

Referring to FIG. 10, there is shown a perspective view, taken from side 5 of FIG. 1, of one style of miniature carousel figurine 25 affixed to, by means not shown, the preferred base. Alternatively, more than one figurine 25 may be mounted to a single base. Some bases may also be displayed without a figurine 25 attached thereto.

Referring now to FIG. 3, there is shown a top plan view of a portion of a full annular stand consisting of twelve sectors and four races. In FIG. 3, the term "annulus" and "annular" as they are used in the specification, mean ring shaped or ring-like shape. Therefore, a partial annular or annulus shape would consist of a partial ring-like shape or curve which does not completely close. Detail "A" of FIG. 4 and detail "C" of FIG. 5 are full annular shapes. Detail "B" of FIG. 4 and detail "G" of FIG. 5 are examples of partial annular shapes. Each race is defined by the circumferences of concentric circles sharing a common center at the center of the annulus. Each sector is defined by two radii originating at the center of the annulus. FIG. 3 shows races 6, 7, 8 and 9 and sectors 10 through 21. FIG. 3 represents the preferred configuration and number of bases of the invention. FIG. 11 shows a perspective view, taken from the side adjacent to sector 21 of FIG. 3, of sector 10 of FIG. 2 with miniature carousel figurines affixed thereon by means not shown. It can be readily appreciated from FIGS. 1, 2, 3, 10, and 11, however, that any number of sectors or races could be added or subtracted from this configuration to create stands of any number of shapes and sizes.

FIGS. 4 and 5 illustrate just a few of the many possible configurations in which the individual bases may be arranged. The overall shape of the stand may be altered by adding or subtracting the number of races, sectors or individual bases. It is not necessary, however, to add or subtract bases in full sectors or races. For example, detail "B" of FIG. 4 shows one half of the annulus occupied by bases, and detail "G" of FIG. 5 illustrates a configuration of randomly placed bases. It is also not necessary to the invention that each of the bases are in contact with or adjoin with at least one other base. Therefore, the invention provides the collector maximum flexibility in displaying carousel figurines in an annular manner.

Alternatively, the bases may be shaped such that they may be arranged in a full or partial circular configuration. For example, triangular or sector shaped bases could be arranged in full or partial circular configurations.

In accordance with a preferred embodiment of the invention, the carousel figurine mounting system includes means for securing a plurality of figurine bases to each other to provide a unitary display assembly.

Referring now to FIGS. 8 and 9, base 1 may be affixed to mounting plate 22 by any conventional means. The preferred means of affixation of each base 1 to mounting plate 22 is by four screws 23 countersunk into plate 22. Plate 22 may be made from any sufficiently rigid material, however, one-eighth inch thick stainless steel is preferred. As an alternative material for plate 22, aluminum may be used.

The mounting plate may take any shape, but preferably it will have the same shape as the configuration of the bases intended to be arranged on it. Additionally, mounting plate 22 preferably will be slightly smaller than the composite size of the arranged bases. In its preferred form, the size of plate 22 will be reduced by three-eighth's of an inch as measured from the perimeter of the arranged bases. Reduction in the mounting plate size will allow for manufacturing tolerances and the expansion and contraction of the bases without exposing the underlying mounting plate 22. The smaller mounting plate will also enhance the appearance of the stand in that the entire stand will appear to be in motion and float on air.

Furthermore, separate plates 22 of a shape adaptable to a preexisting stand may be added at any time to either increase the stand's capacity or alter the configuration of the display. This feature further illustrates the versatility of this invention.

Referring once again to FIG. 9, mounting feet 24 may be optionally affixed to the lower surface of the mounting plate 22. The feet 24 may be affixed by any conventional means, but are preferably mounted to the mounting plate 22 with screws. Although as few as three support feet 24 may be used, four is preferred. The feet 24 may be arranged in any configuration on the lower surface of mounting plate 22 so long as the stand remains stable. The feet 24 give the appearance that the entire stand is in motion and floating on air and, if fabricated of suitable material such as rubber, may prevent the stand from slipping on the surface on which it is placed.

It will, therefore, be appreciated that any embodiment of this invention provides the collector of miniature carousel figurines with maximum versatility in displaying such figurines. The configuration of the display stand, although simple in concept, is powerful in its application. Such a configuration provides the collector with numerous choices in displaying figurines with a stand which will grow as the collector's collection grows. The stand provides an aesthetically pleasing display base while providing the viewer of the display with the illusion of a carousel floating above the surface upon which the stand rests.

While for the purposes of illustration specific shapes of the individual bases 1 and specific configurations of those bases have been shown, it will be appreciated that the advantageous features of this invention are not so limited and modifications thereof will be apparent to one skilled in the art.

Whereas particular embodiments of the invention have been described above for purposes of illustration, it will be evident to those skilled in the art that numerous variations of the details may be made without departing from the spirit and scope of the invention as set forth in the foregoing specification and the appended claims.

What is claimed is:

1. An apparatus for displaying a miniature carousel figurine comprising:

generally planar base having upper and lower surfaces and three side surfaces, a pair of side surfaces being defined by two radii of a circle; and one or more miniature carousel figurines affixed to the base.

2. The apparatus in claim 1, wherein the base has upper and lower surfaces and four side surfaces, a pair of side surfaces being defined by two radii of a circle.

3. The apparatus in claim 2, wherein the remaining pair of side surfaces of the base are defined by arcs of concentric circles which share the same center point as the circle from which the radii emanate.

4. The apparatus in claim 2, wherein the remaining pair of side surfaces of the base are defined by the chords of the arcs of concentric circles which share the same center point as the circle from which the radii emanate.

5. The apparatus in claim 2, wherein at least one side surface of said base is beveled.

6. The apparatus of claim 2, wherein the base is made of walnut wood.

7. The apparatus of claim 2, wherein the apparatus comprises a plurality of bases arranged in a full or partial annular or circular shape.

8. An apparatus for displaying miniature carousel figurines comprising:

a plurality of bases, each having a miniature carousel figurine attached to it;

a mounting plate having an upper surface and a lower surface, the upper surface of the plate having a plurality of said bases affixed thereto to form a full or partial annular or circular shape; and three or more support feet affixed to the lower surface of the mounting plate.

9. The apparatus of claim 8, wherein each base is generally triangular in shape.

10. The apparatus of claim 8, wherein each base has upper and lower surfaces and four side surfaces.

11. A method of displaying miniature carousel figurines comprising the steps of:

affixing one or more figurines to one or more bases wherein each base is shaped such that the bases, either individually or in a plurality, may be arranged to form a full or partial annular or circular shape; and arranging the bases such that the bases form a full or partial annular or circular shape.

12. An apparatus for displaying miniature carousel figurines comprising:

a generally planar base having upper and a lower surface and three side surfaces, a pair of side surfaces being defined as two radii of a circle;

one or more miniature carousel figurines affixed to the base;

a plurality of bases arranged in a full or partial, annular or circular shape; and a mounting plate having an upper surface and a lower surface, wherein each base is affixed to the upper surface of the plate in a full or partial, annular or circular shape.

13. The apparatus of claim 12, wherein the mounting plate has substantially the same annular or circular shape as that formed by the bases.

14. The apparatus of claim 12, wherein the mounting plate is sized such that the mounting plate is not visible when the apparatus is observed in an upright position.

15. The apparatus of claim 12, wherein the mounting plate is made of stainless steel.

16. The apparatus of claim 12, further comprising three or more support feet affixed to the lower surface of the mounting plate.

17. The apparatus of claim 12, wherein the base has four side surfaces.

18. The apparatus of claim 17, wherein the mounting plate has substantially the same annular or circular shape as that formed by the bases.

19. The apparatus of claim 17, wherein the mounting plate is sized such that the mounting plate is not visible when the apparatus is observed in an upright position.

20. The apparatus of claim 17, wherein the mounting plate is made of stainless steel.

21. The apparatus of claim 17, further comprising three or more support feet affixed to the lower surface of the mounting plate.

22. A method of displaying miniature carousel figurines comprising the steps of:

affixing one or more figurines to one or more bases wherein each base is shaped such that the bases, either individually or in a plurality, may be arranged to form a full or partial, annular or circular shape;

arranging the bases such that the bases form a full or partial, annular or circular shape; and affixing each base to an upper surface of a mounting plate, the mounting plate having an upper and lower surface, to form a full or partial, annular or circular shape.

23. The method in claim 22, further comprising the additional step of affixing three or more feet to the lower surface of the mounting plate.

* * * * *

UNITED STATES PATENT AND TRADEMARK OFFICE

CERTIFICATE OF CORRECTION

PATENT NO. : 5,167,586

DATED : Dec. 1, 1992

INVENTOR(S) : Terri-lee Morris

It is certified that error appears in the above-identified patent and that said Letters Patent is hereby corrected as shown below:

Col. 3, line 20, delete "pace" and insert --race--.

Col. 6, line 1, delete "in" and insert --of--.

Col. 6, line 4, delete "in" and insert --of--.

Col. 6, line 8, delete "in" and insert --of--.

Col. 6, line 13, delete "in" and insert --of--.

Signed and Sealed this

Eleventh Day of January, 1994

Bruce Lehman

*Attest:*

BRUCE LEHMAN

*Attesting Officer*

*Commissioner of Patents and Trademarks*